US010407895B2

(12) United States Patent
Krohmer

(10) Patent No.: US 10,407,895 B2
(45) Date of Patent: Sep. 10, 2019

(54) PORTABLE MODULAR SYSTEM FOR STRUCTURAL ASSEMBLIES

(71) Applicant: Dieter Krohmer, Calgary (CA)

(72) Inventor: Dieter Krohmer, Calgary (CA)

( * ) Notice: Subject to any disclaimer, the term of this patent is extended or adjusted under 35 U.S.C. 154(b) by 0 days.

(21) Appl. No.: 15/854,201

(22) Filed: Dec. 26, 2017

(65) Prior Publication Data

US 2018/0179751 A1 Jun. 28, 2018

Related U.S. Application Data

(60) Provisional application No. 62/438,854, filed on Dec. 23, 2017.

(51) Int. Cl.
*E04B 1/343* (2006.01)
*E04B 1/32* (2006.01)
(Continued)

(52) U.S. Cl.
CPC ..... *E04B 1/34321* (2013.01); *E04B 1/3205* (2013.01); *E04B 1/34326* (2013.01);
(Continued)

(58) Field of Classification Search
CPC .... E04B 1/34321; E04B 1/3205; E04B 7/102; E04B 1/34326; E04B 1/34384; E04B 2001/3276; E04B 1/32; E04B 2/8635; E04B 2/86; E04B 2/8641; E04B 2/8611; E04B 2/8617; E04B 2/8623; E04B 2/8629; E04B 2/02; E04B 2002/0202; E04B 2002/0243;
(Continued)

(56) References Cited

U.S. PATENT DOCUMENTS 3,037,590 A * 6/1962 Pavlecka ..... E04C 2/08 52/275
3,640,039 A 2/1972 McKee et al.
(Continued)

FOREIGN PATENT DOCUMENTS

CA 2367664 A1 * 11/2000 ..... E04B 2/8635
CA 2299193 A1 * 8/2001 ..... E04B 2/8641
(Continued)

*Primary Examiner* — Adriana Figueroa
*Assistant Examiner* — Jessie T Fonseca
(74) *Attorney, Agent, or Firm* — Pierce Atwood LLP; Kevin M. Farrell

(57) ABSTRACT

The present invention provides a modular system for constructing a structure assembly. The system comprises first and second sidewall components each comprising a set of spaced-apart longitudinally oriented grooves disposed in a first face thereof. The system comprises a plurality of rib components, each rib component having a pair of elongated protrusions extending from opposing sides of the rib component and, each protrusion being shaped to matingly engage with at least the first portion of the groove to connect the first and second sidewall components along a face-to-face direction. The system further comprises two elongate key joint members matingly engaging with two respective additional sidewall components to connect the sidewall components with the additional sidewall components along a transverse direction perpendicular to the face-to-face direction in a side to side relationship.

10 Claims, 18 Drawing Sheets

(51) Int. Cl.
*E04B 7/10* (2006.01)
*E04C 3/46* (2006.01)

(52) U.S. Cl.
CPC ..... *E04B 1/34384* (2013.01); *E04B 7/102* (2013.01); *E04C 3/46* (2013.01); *E04B 2001/3276* (2013.01)

(58) Field of Classification Search
CPC ..... E04B 2002/0247; E04B 2002/0252; E04B 2/42; E04B 2/44; E04B 2/46; E04B 2/48; E04B 2/50; E04B 2/52; E04B 2/54; E04B 9/02; E04C 3/46; E04G 9/02
See application file for complete search history.

(56) References Cited

U.S. PATENT DOCUMENTS 3,828,502 A * 8/1974 Carlsson ..... E04B 1/14 52/125.4
4,196,555 A * 4/1980 Henges, Jr. ..... E04B 1/34321 52/588.1
4,433,522 A * 2/1984 Yerushalmi ..... E04H 9/10 52/249
5,608,999 A * 3/1997 McNamara ..... E04B 1/12 52/220.1
5,685,113 A * 11/1997 Reuter ..... E04B 2/7422 174/651
5,706,620 A 1/1998 De Zen
5,740,648 A * 4/1998 Piccone ..... E04B 2/86 249/191
5,953,880 A 9/1999 De Zen
6,240,692 B1 * 6/2001 Yost ..... E04B 2/8635 52/426
6,293,067 B1 * 9/2001 Meendering ..... E04B 2/8652 52/426
6,435,471 B1 * 8/2002 Piccone ..... E04B 2/8641 249/191
8,327,582 B2 12/2012 Storey
9,091,061 B2 * 7/2015 Dincel ..... E04B 1/0007
9,725,900 B2 * 8/2017 Correia ..... E04C 1/00
9,982,444 B2 * 5/2018 Richardson ..... E04G 17/00
2003/0009967 A1 * 1/2003 Piccone ..... E04B 1/12 52/426
2004/0045238 A1 * 3/2004 Dunn ..... E04B 2/8641 52/309.11
2005/0016083 A1 * 1/2005 Morin ..... E04B 2/8641 52/79.14
2005/0016103 A1 * 1/2005 Piccone ..... E04B 2/8641 52/481.1
2006/0032172 A1 * 2/2006 Foell ..... E04B 2/8629 52/426
2009/0308011 A1 * 12/2009 Philippe ..... E04B 2/8635 52/426
2010/0251657 A1 * 10/2010 Richardson ..... E04B 2/8641 52/588.1
2010/0325984 A1 * 12/2010 Richardson ..... E04G 15/02 52/215
2011/0000161 A1 * 1/2011 Aube ..... E04B 2/46 52/563
2012/0090251 A1 * 4/2012 Andreini ..... E04C 2/328 52/81.6
2014/0260055 A1 * 9/2014 Pfeiffer ..... E04G 17/12 52/582.1
2015/0091207 A1 * 4/2015 McCary, Sr. ..... E04B 2/8658 264/273
2016/0168849 A1 * 6/2016 Ryan ..... E04B 2/8641 52/404.2
2016/0194868 A1 * 7/2016 DeBoer ..... E04B 2/32 52/604
2018/0209115 A1 * 7/2018 Henriquez ..... E04G 17/004

FOREIGN PATENT DOCUMENTS

CA 2243905 C * 5/2002 ..... E04B 2/8641
CA 2449145 A1 * 5/2004 ..... E04B 2/8623
CA 2855742 A1 * 5/2013 ..... E04B 2/8635
CA 2859608 A1 * 7/2013 ..... E04G 23/0218
CA 2952636 A1 * 12/2015 ..... E04B 2/8629
CA 2930366 A1 * 11/2016 ..... E04B 2/86
WO 9849403 A2 11/1998
WO WO-2013188980 A1 * 12/2013 ..... E04G 23/0218
WO 2014209450 A1 12/2014

* cited by examiner

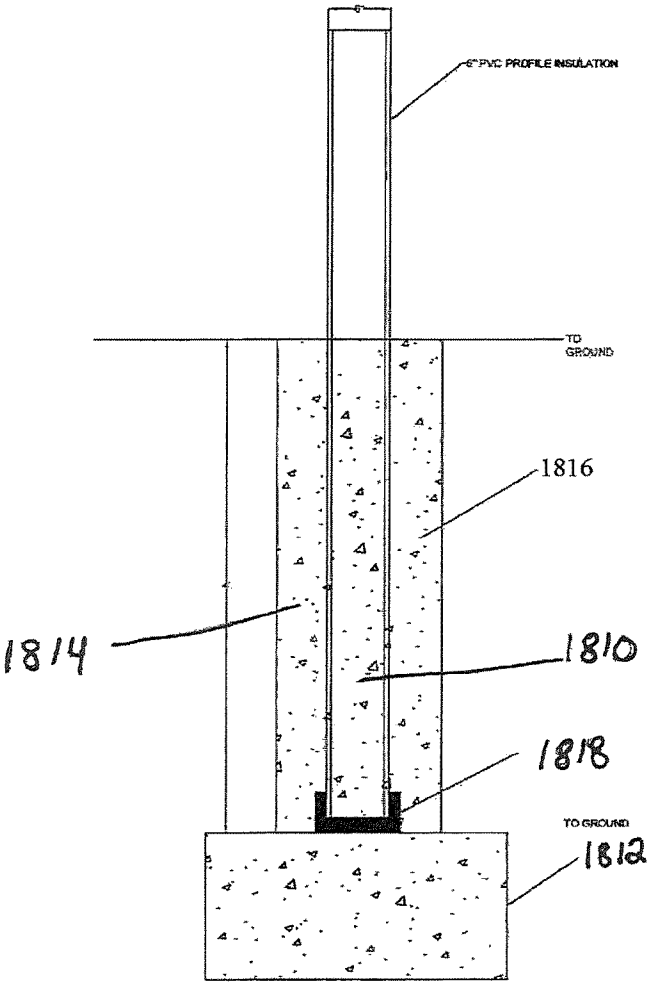
FIG. 19 ( DETAIL VIEW )

PORTABLE MODULAR SYSTEM FOR STRUCTURAL ASSEMBLIES

FIELD OF THE INVENTION

The present invention pertains in general to modular structural assemblies and in particular to portable modular system for constructing structural assemblies for varying size.

BACKGROUND

Modular building is a technique of construction of temporary or permanent structures, such as construction camps, schools, classrooms, community centers, disaster relief housing, civilian or military housing, and industrial facilities. It is also highly desirable in remote areas where conventional construction techniques may be unavailable or unfeasible due to lack of resources, construction crews, or difficult access.

There are many known disadvantages of traditional site-built structures that may be addressed by a highly mobile and cost effective modular building technique. For example, site-built structures are typically constructed from concrete, metal and wood. Increased or prohibitive costs may be involved in transporting the building materials and construction workers to the build site. Use of concrete requires the materials to be mixed and poured at the job site by a concrete mixing truck. Concrete is also prone to cracking due to thermal stresses and seismic activity. Likewise wood building materials often need to be suitably stored at the construction site, and for larger beams, whether wood or metal, heavy duty transportation or handling may be required. In addition, wood structures can be susceptible to infestation by pests, such as termites and mice. Wood also can deteriorate due to environmental factors such as fungus or other rot. Furthermore, typical wood, metal and concrete structures cannot be readily disassembled and moved to a different location, leading to waste of building materials if the building becomes unneeded.

Accordingly, there is a need for an easily transportable and readily assembled pre-fabricated building structure and assembly technique. There is also a need for a building structure that can be disassembled and either re-used or recycled. Further, there is also a need for a building process that is flexible, fast and environmentally friendly.

SUMMARY

An object of the present invention is to provide a modular system for constructing a structure assembly. The system comprises at least two elongated hollow panels, each panel having a first end and a second end, spaced apart first and second sidewalls connected by first and second edge walls, and a first web wall extending between the side walls adjacent the first edge wall, and a second web wall extending between the side walls adjacent the second edge wall. Each of said edge walls comprises a pair of spaced apart longitudinally oriented grooves. The base of each of said grooves is attached with the respective web wall, to form a central joint support channel between said grooves. There are at least one joint support member, each having a first end and a second end. Said first and second ends are configured to frictionally engage the central joint support channel of a first panel and a central joint support channel of a second panel, respectively, to connect these two panels along a longitudinal direction in an end to end relationship. There are at least two flexible key resilient joints, each having a first side portion and a second side portion, configured to frictionally engage the side grooves of the first panel and the side grooves of an additional panel, respectively, to connect these two panels along a transverse direction perpendicular to the longitudinal direction in a side to side relationship.

Another object of the present invention is to provide a modular system for constructing a structure assembly, the system comprising: first and second sidewall components, each comprising a set of spaced-apart longitudinally oriented grooves disposed in a first face thereof, wherein the grooves include a first portion in which a width of the grooves increases with depth into the grooves; and a plurality of rib components, each rib component having a pair of elongated protrusions extending from opposing sides of the rib component and, each protrusion being shaped to matingly engage with at least the first portion of the groove to connect the first and second sidewall components along a face-to-face direction.

BRIEF DESCRIPTION OF THE FIGURES

The foregoing and other objects of the disclosure will be apparent upon consideration of the following detailed description, taken in conjunction with the accompanying drawings, in which:

FIG. 19 illustrates an enlarged/detail view of an end of FIG. 18.

DETAILED DESCRIPTION

In the following paragraphs, embodiments will be described in detail by way of example with reference to the accompanying drawings, which are not drawn to scale, and the illustrated components are not necessarily drawn proportionately to one another. Throughout this description, the embodiments and examples shown should be considered as exemplars, rather than as limitations of the present disclosure.

As used herein, the "present disclosure" or "present invention" refers to any one of the embodiments described herein, and any equivalents. Furthermore, reference to various aspects of the invention throughout this document does not mean that all claimed embodiments or methods must include the referenced aspects or features.

Figure 1:
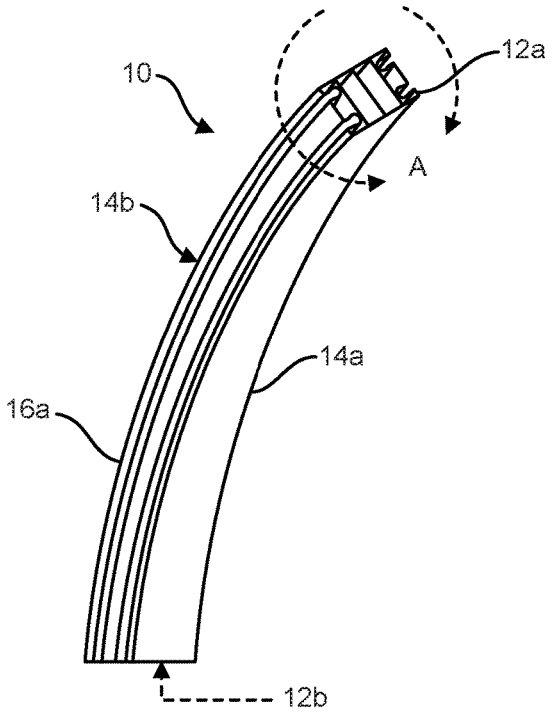
FIG. 1 illustrates a perspective view of a curved panel in accordance with the present invention.
Figure 2:
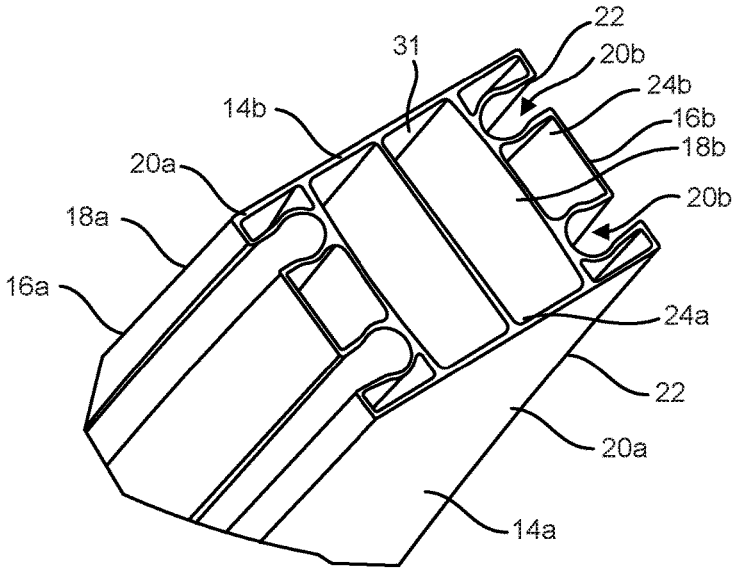
FIG. 2 illustrates a part perspective, part end view of a partial curved panel of part A of FIG. 1 in accordance with the present invention.
Figure 3:
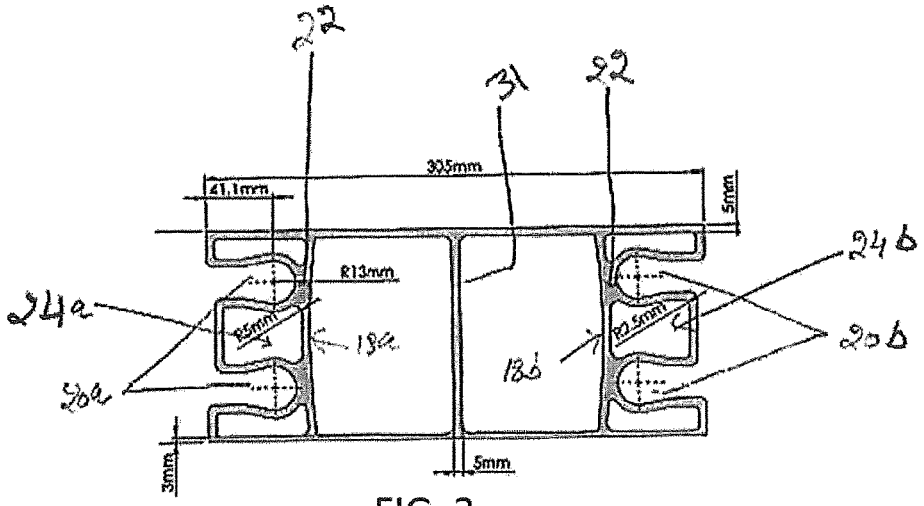
FIG. 3 illustrates an end view of a panel in accordance with the present invention.

As depicted in FIGS. 1 and 2, a single elongated hollow panel 10 is provided having first and second ends 12*a* and 12*b*, a first (inner) side wall 14*a* and a second side wall 14*b* (outer), first and second edge walls 16*a* and 16*b*. The first and second wall webs 18*a* and 18*b* extend between the side walls adjacent the first and second edge walls, respectively.

Each of said edge walls comprises a pair of spaced apart grooves 20*a* and 20*b* which extend along the length of the respective edge wall. The base 22 of each of said grooves is attached with the respective web wall to form central joint support channels 24*a* and 24*b* between said grooves to receive the joint support members 26 (see e.g. FIGS. 4 and 5) to connect two or more panels in an end to end relationship. In this embodiment, there is only one joint support channel between a pair of side grooves on each side edge wall. The invention is not limited to this configuration. There could be more than two spaced apart grooves and multiple joint support channels, each between a pair of the grooves without departure of the scope and sprit of the invention.

In some embodiments the joint support members 26 each has a first end 26*a* and a second end 26*b* (FIG. 5), which are configured to frictionally engage the central joint support channels of two interconnecting panels in an end to end relationship. For example, the first end 26*a* of the joint support member may be engaged with the central joint support channel 24*a* of a first panel, and the second end 26*b* may be engaged with the central joint support channel of a second panel so that the two elongated panels are connected along the longitudinal direction in an end to end relationship. Further, a first end 26*a* of a second joint support member may be engaged with the central joint support channel 24*b* of the first panel located on the other edge wall, and a second end 26*b* of the second joint support member may be engaged with another central joint support channel of the second panel. The two joint support members strengthen the connection of the two panels. The two elongated panels are then connected together along the longitudinal direction in an end to end relationship via the joint support members.

Figure 6:
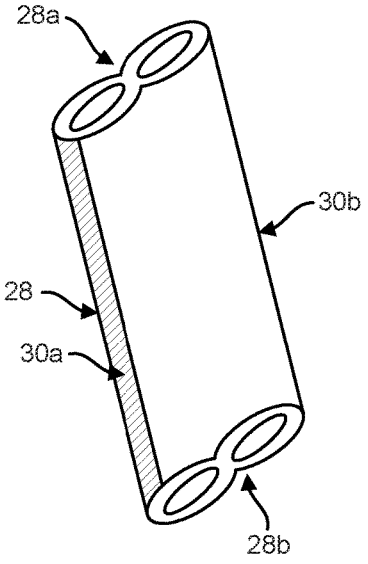
FIG. 6 illustrates a perspective view of joint support members in accordance with the present invention.
Figure 7:
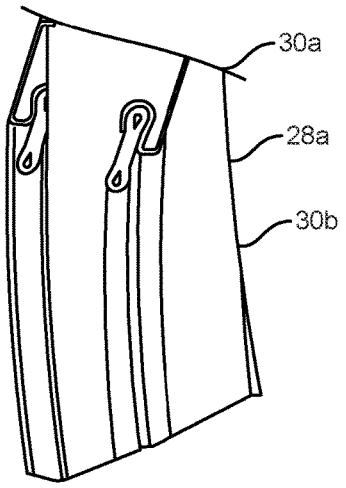
FIG. 7 illustrates a part perspective view of a panel in accordance with the present invention showing key finger joints engaged in the side grooves of the panel.

The modular system of the present invention further includes resilient key joint members 28, which are configured to frictionally engage the side grooves of two interconnecting panels in a side to side relationship. In some embodiments, the key joint member comprises a first end portion 28*a* and a second end portion 28*b*, a first edge portion 30*a* and a second edge portion 30*b* as shown in FIGS. 6 and 7. The first edge portion 30*a* may be engaged with a side groove 20*a* of a first panel 12, and the second edge portion 30*b* may be engaged with a side groove 20*b* of a second panel 14. In this way, two panels are connected in a transverse direction perpendicular to the longitudinal direction, in a side to side relationship. Further, a second resilient key joint member 28 may be engaged with another groove 20*a* of the first panel 12 and another groove 20*b* of the second panel 14 to strengthen the connection along this direction, shown in FIG. 4.

Figure 4:
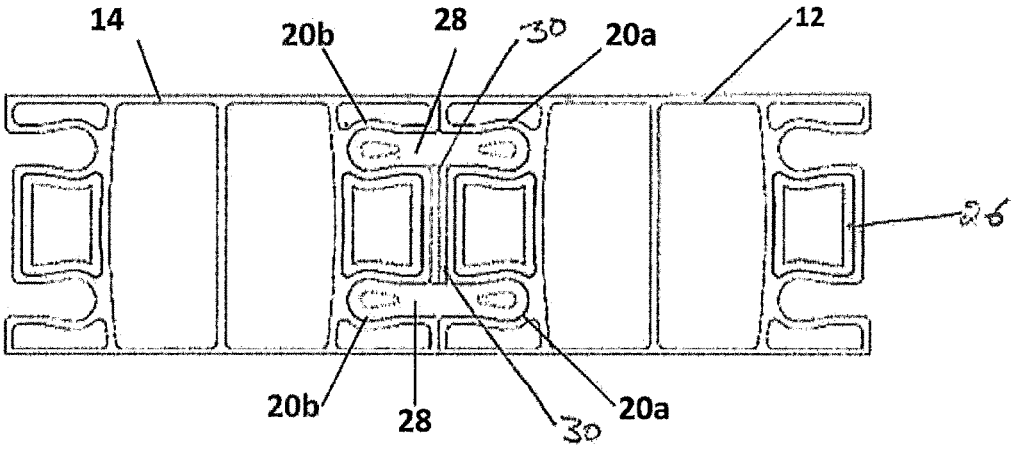
FIG. 4 illustrates cross section view of an assembly of panels in accordance with the present invention showing a side to side connection and end to end connection relationship.
Figure 5:
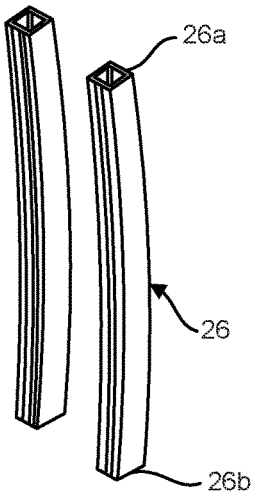
FIG. 5 illustrates a perspective view of joint support members in accordance with the present invention.

Referring still to FIG. 4, the key joint members 28 fit within grooves (e.g. 20*a*, 20*b*), and the joint support member 26 fits within a joint support channel (e.g. 24*a*, 24*b*). Between an adjacent groove and joint support channel of a panel is a commonly shared wall forming part of the panel. The key joint member presses in a first direction against the shared wall, while the joint support member presses in a second direction against the same shared wall, the second direction being opposite to the first direction. This opposing pressure may in some embodiments enhance integrity of the assembled structure, for example by further enhancing retention of the key joint members and joint support members with the panels to which they are attached.

Additionally or alternatively, the presence of two or three adjacent and contacting bodies (the shared wall and one or both of the key joint member and the joint support member) can lead to improved integrity and/or rigidity of the structure. This is because the resulting two- or three-layered structure may provide more rigidity and support than a single layer. For this reason, and in some embodiments, the key joint members and/or joint support members can be made as long as possible. For example at least half as long as the panels, as long as the panels, or longer than the panels.

Figure 9:
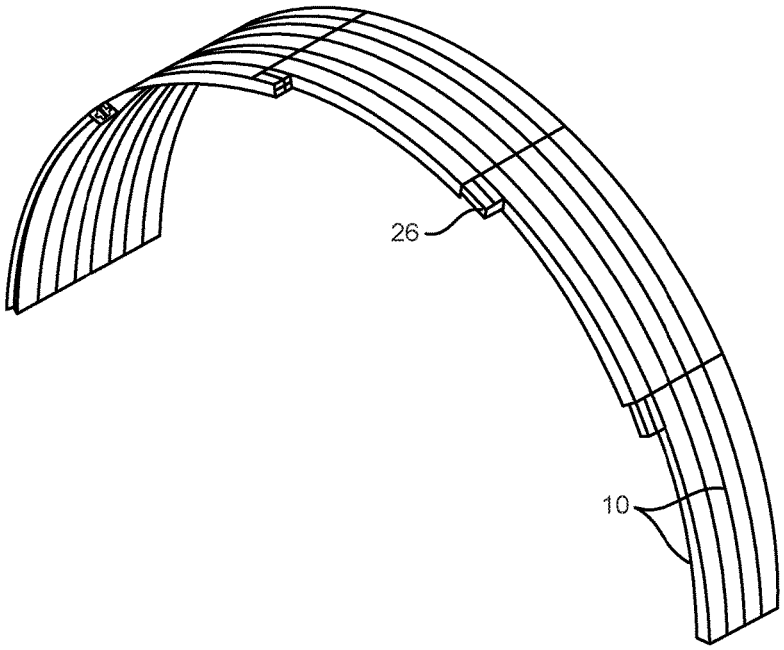
FIG. 9 illustrates a perspective view of a building structure formed from plurality of connected modules in accordance with the invention.

Using a combination of joint support members 26 and key joint members 28, multiple panels 10 can be connected together both end-to-end and side-to-side to form a wall or structure. FIG. 9 shows an example in which a plurality of elongated curved panels are connected longitudinally and transversely to build a continuous wall of a building structure. In this embodiment, the elongated hollow panel 10 has curved side walls and edge walls along the longitudinal direction. The grooves and the central support channels are also curved as well along the longitudinal direction and have the same curvature as the side walls.

In some embodiments, the panels of the present invention have one or more additional web walls 31 extending between the side walls to form two or more compartments, which can optionally be filled with insulation material.

The panels of the modular system can be made of one or more of a variety of materials. In some embodiments, the panels are made of light weight material, such as thermoplastic. Panels can be any length and shape depending upon the shape and size of the desired structure to be constructed from the panels. In one exemplary embodiment, the panels have a length of between 5 ft and 20 ft (or 1.2 to 6 meters). In some embodiments, the panels have a length of between 5 ft and 10 ft. The panels can be curved or straight.

The joint support members and the resilient key joint members can vary in length. In some embodiments, the key joint member extends along the entire length of one or more panels.

A notable feature of the modular system of the present invention is its portability and ease of shipping. Each panel can be sized so that it can be lifted by one or two persons. The panels can be assembled easily, sometimes by a single person, to provide a safe and secure desired structure.

In some embodiments, the assembly of the panels of the present invention can be achieved by first laying out two or more panels sideways (on their edge walls) in an end to end relationship on ground followed by inserting one end of a joint support member into the central channel of one panel and the other end of the joint support member into the central channel of another panel to be connected and optionally applying force to achieve secure frictional engagement of the joint support within the central channels of the two connected panels.

Figure 8:
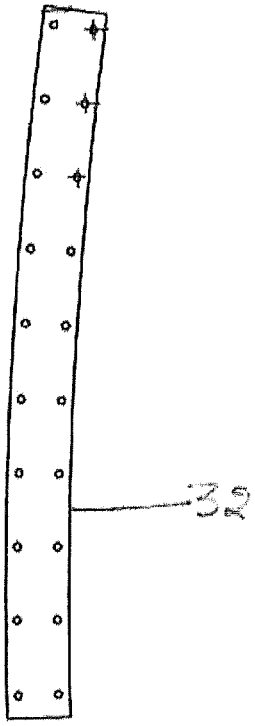
FIG. 8 illustrates a plan view of splice plate in accordance with the present invention.

Optionally splice plates 32 are provided on the outer sides of the edge walls in alignment with the inserted joint support member to provide a further support to the joint support member within the central channels of the interconnecting panels. The splice plates shown in FIG. 8 can be attached to the edge walls and the joint member via fasteners such as screws. This process is repeated to achieve the shape and size of a desired structure.

The side to side attachment of the panels is achieved by connecting the edge wall of one panel with the edge wall of another panel via inserting the resilient key joint member into the side grooves. Once the end to end and side to side assembly of the panels is achieved, the completed structure is tilted up to erect the structure on a desired surface.

In some embodiments the erected structure is further supported by fasteners such as screws from the inside of the structure.

In some embodiments, the side to side attachment of the panels is a done in a manner so that the end to end joints are staggered.

Figure 10A:
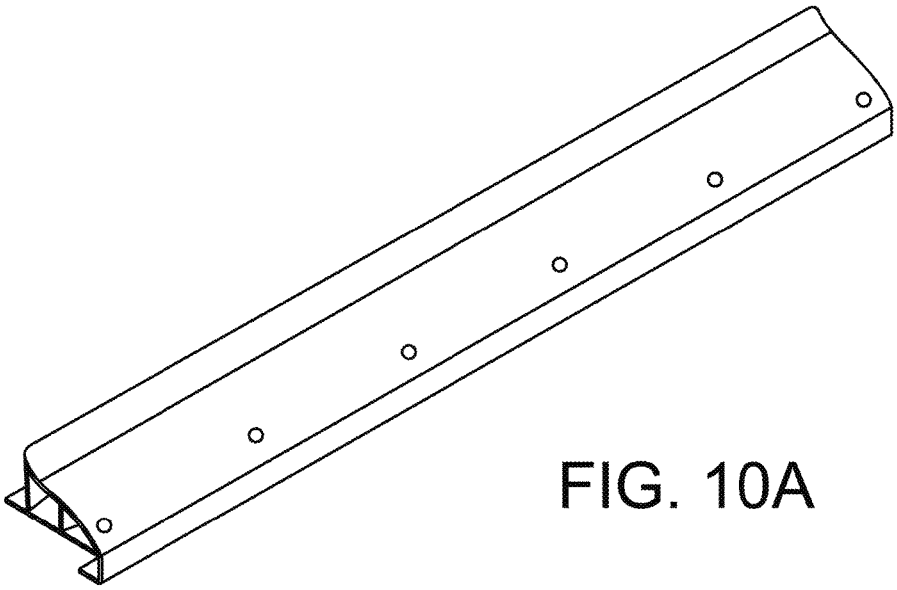
FIG. 10A illustrates a perspective view of a base support in accordance with the present invention.
Figure 10B:
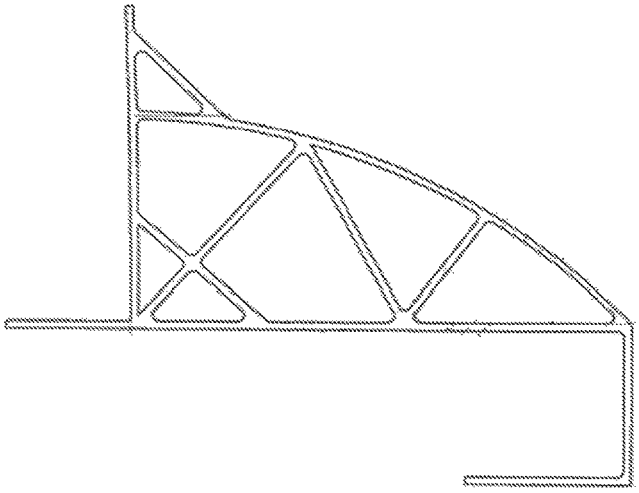
FIG. 10B illustrates a cross-sectional view of the base support of FIG. 10A.

In some embodiments, the panels of the present invention can be erected on any surface without foundation requirements. In some embodiments, the panels can be attached to a base support as shown in FIGS. 10A and 10B. In some embodiments, one or more panels can be used as foundation panel(s). A foundation panel or base support can be placed below grade, for example resting on a concrete footing and surrounded by concrete inner and outer walls or gravel fill. The foundation panel can be anchored in place using one or more connection members affixed to the concrete footing.

Another notable feature is the ease of disassembly of the modular structure formed by the modular system of the present invention, which can be achieved by unscrewing the bolts and pulling the side panels and end to end panels away from each other.

Modular Panel

Embodiments of the present invention provide for a modular system for constructing a structure assembly panel, as will be described below. Multiple separate pieces are mated together to form each structure assembly panel, and the panels are mated together to form a structure assembly. After assembly of a panel, cavities within the panel can optionally be filled with material, such as spray foam or another insulator. Snap-in connections can be used to mate the components of the panel together. A panel may be filled with insulation or another filling material. The filling material can be of a desired density and hardness, thereby providing additional comprehensive strength to the panel. The use of such a filler can reinforce the assembly structure for a desired use, such as a bridged or arched structure, or other large structure (see e.g. FIG. 18).

Figure 11A:
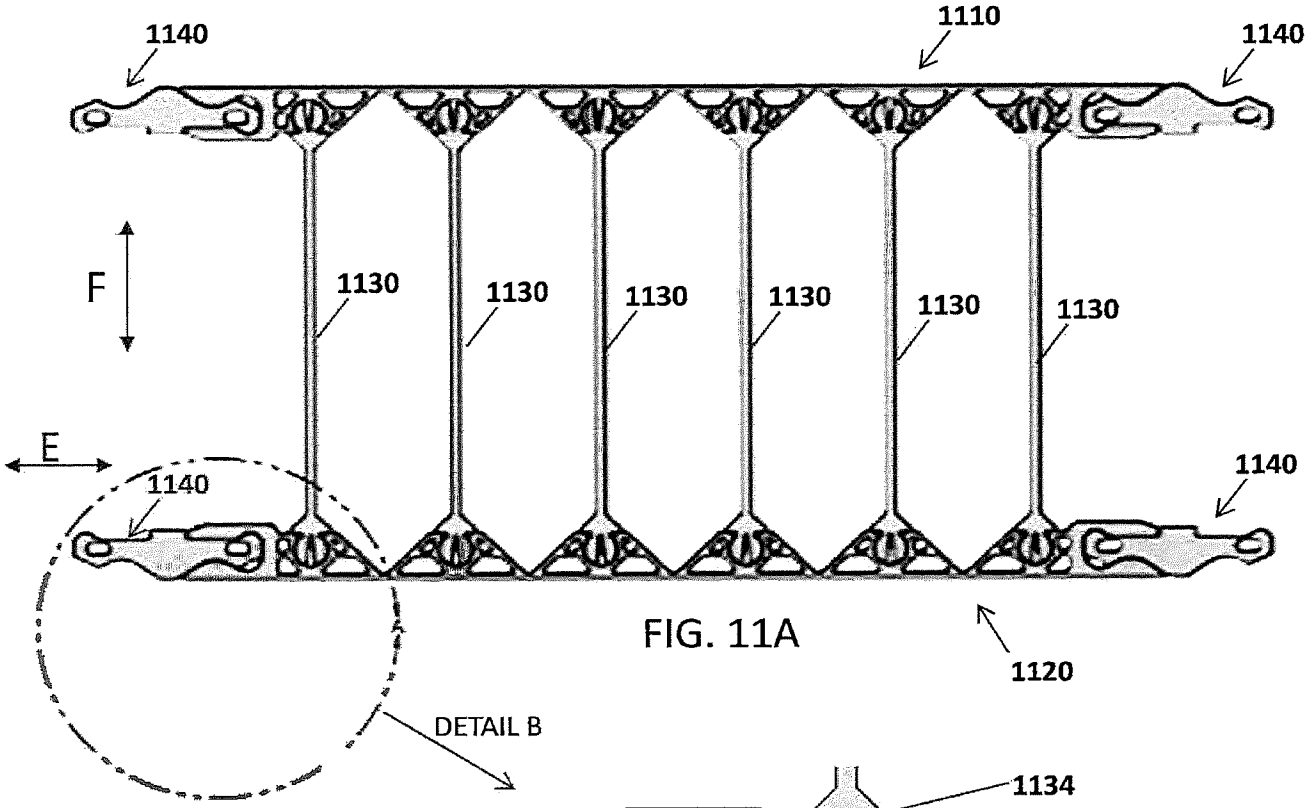
FIG. 11A illustrates a cross-sectional view of an assembled panel, according to an embodiment of the present invention.

FIG. 11A illustrates a cross-sectional view of an assembled panel, according to an embodiment of the present invention, while FIGS. 12A to 12E illustrate, in cross section, separate components of the panel. The panel includes a first sidewall component 1110 and a second sidewall component 1120, which are disposed in a spaced-apart configuration with first faces facing one another. Each sidewall component, for example, could be a two-dimensional panel extending along a longitudinal direction L and a transverse direction E perpendicular to the longitudinal direction L, shown in FIG. 13. On the first face of each sidewall component are disposed a set of spaced-apart longitudinally oriented grooves 1112. The grooves include a first portion (the top half of the groove) in which a width of the grooves increases with depth into the groove. The panel further includes a plurality of rib components 1130. Each rib component has a pair of protrusions 1132 extending from opposing sides of the rib component. In some embodiments, the rib component comprises a two-dimensional connection body 1135 between the pair of protrusions for connecting the two protrusions. The width of the connection body 1135 between the pair of protrusions determines the thickness of the final assembled panel. Various widths of ribs can produce different thicknesses of assembled panels according to requirement. Each protrusion is elongated in the longitudinal direction (i.e. the direction perpendicular to the illustrated cross section) along one edge of the connection body 1135. Each protrusion is shaped to matingly engage with at least the first portion of the groove, for example via snap-in connection. Each rib component is connected to both the first and second sidewall components by disposing one of the protrusions within a groove of the first sidewall component and the other protrusion within a groove of the second sidewall component such that the two sidewall components 1110 and 1120 are connected along a face to face direction F shown in FIG. 11A via the rib components. The ribs provide connectivity in a further direction, for example perpendicular to the connectivity directions provided by the joint support members 26 and key joint members 28.

Each rib component 1130 includes a pair of flared ends 1134. Each flared end 1134 provides for a side face 1136 which engages with one of the sidewall components upon mating engagement. The side face 1136 contributes to holding the rib component at a fixed angle relative to the sidewall component. The (e.g. triangular) flaring outward to the side faces facilitates structural rigidity.

In the presently illustrated embodiment, the protrusions 1132 are substantially circular in cross section. Further, a V-shaped notch 1133 formed in the end of each protrusion 1132. The protrusion is formed of a resilient material, and the presence of the notch allows for temporary inward deformation of the protrusion upon pressing of the protrusion 1132 into the groove 1112. This assists with snap-in connection.

Also in the presently illustrated embodiment, the sidewall components 1110, 1120 comprise a set of longitudinally extending reinforced sections 1114 housing the grooves 1112. The reinforced section comprises a pair of mutually facing hooks or hooked teeth 1115, 1116 which define one of the grooves there between. Regions between adjacent reinforced sections 1114 can be devoid of material (at least prior to filler material being added). In some embodiments, successive reinforced sections are spaced apart from one another, and the longitudinally extending region of the sidewall component located between reinforced sections can be flexible. That is, the sidewall can be bent at the regions between reinforced sections, or where adjacent reinforced sections meet, due to the lack of reinforcement at these regions. A reinforced section may be filled with insulation or another filling material. The filling material can be of a desired density and hardness, thereby providing additional comprehensive strength to the reinforced section. The use of such a filler can reinforce the assembly structure for a desired use, such as a bridged or arched structure, or other large structure.

Figure 11B:
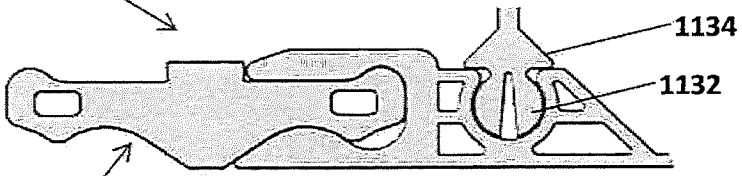
FIG. 11B illustrates an enlarged view of part B of the assembled panel of FIG. 11A.
Figure 12A:
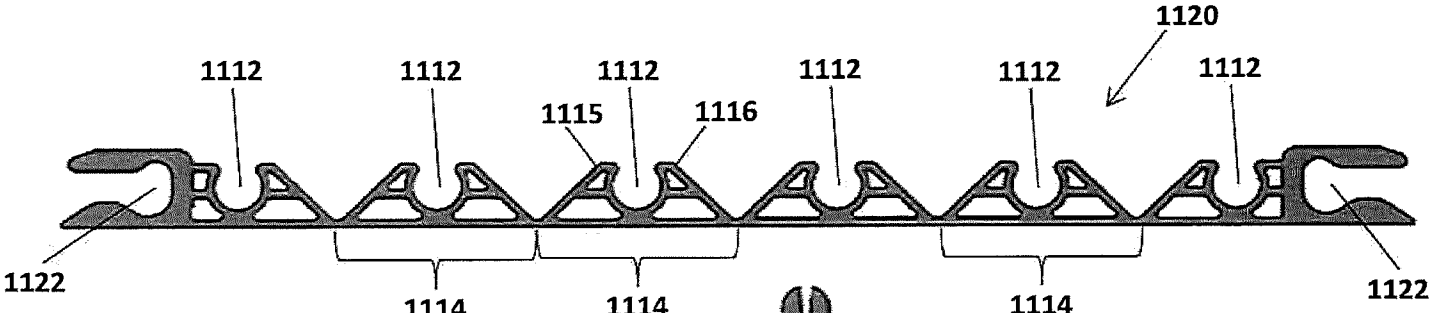
FIG. 12A illustrates, in cross section, a sidewall component of the panel of FIG. 11A.
Figure 12B:
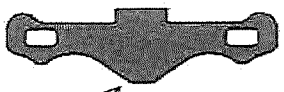
FIG. 12B illustrates, in cross section, a key joint member component of the panel of FIG. 11A.
Figure 12C:
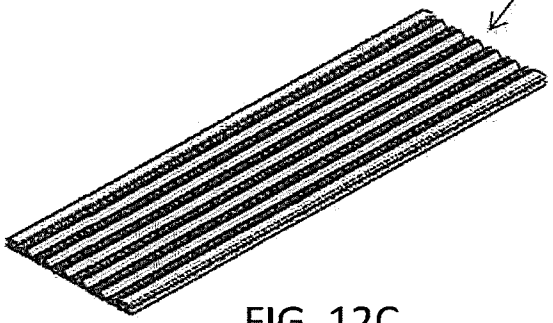
FIG. 12C illustrates a perspective view of the sidewall component of FIG. 12A.
Figure 12D:
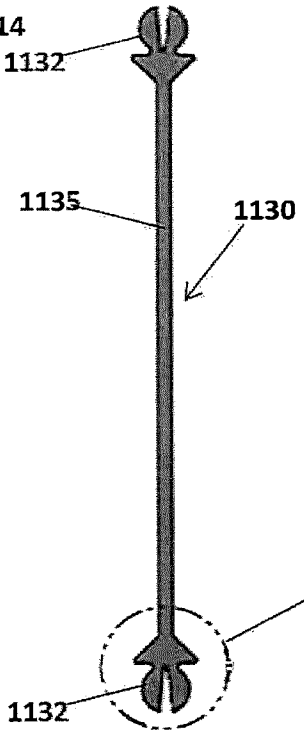
FIG. 12D illustrates, in cross section, a rib component of the panel of FIG. 11A.
Figure 12E:
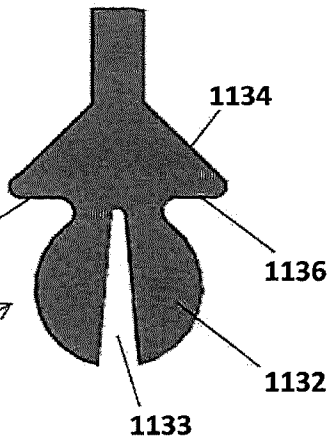
FIG. 12E illustrates, in cross section, an enlarged view of part C of the rib component of FIG. 12D.

FIGS. 11B and 12B further illustrate elongate key joint members 1140 which are matingly engaged with the sidewall components 1110, 1120. In the present illustrated embodiment, each of the sidewall components 1110, 1120 further comprises a longitudinally oriented end groove 1122 disposed within an end face thereof. The end groove is configured to matingly and resiliently engage with one of the key members 1140 in a snap-in configuration. The key joint members 1140 are further configured to matingly and resiliently engage with two respective additional sidewall components (not shown) using another snap-in connection, thereby connecting the sidewall components with the additional sidewall components along a transverse direction E shown in FIG. 11A, perpendicular to the face to face direction F, in a side to side relationship.

Figure 17:
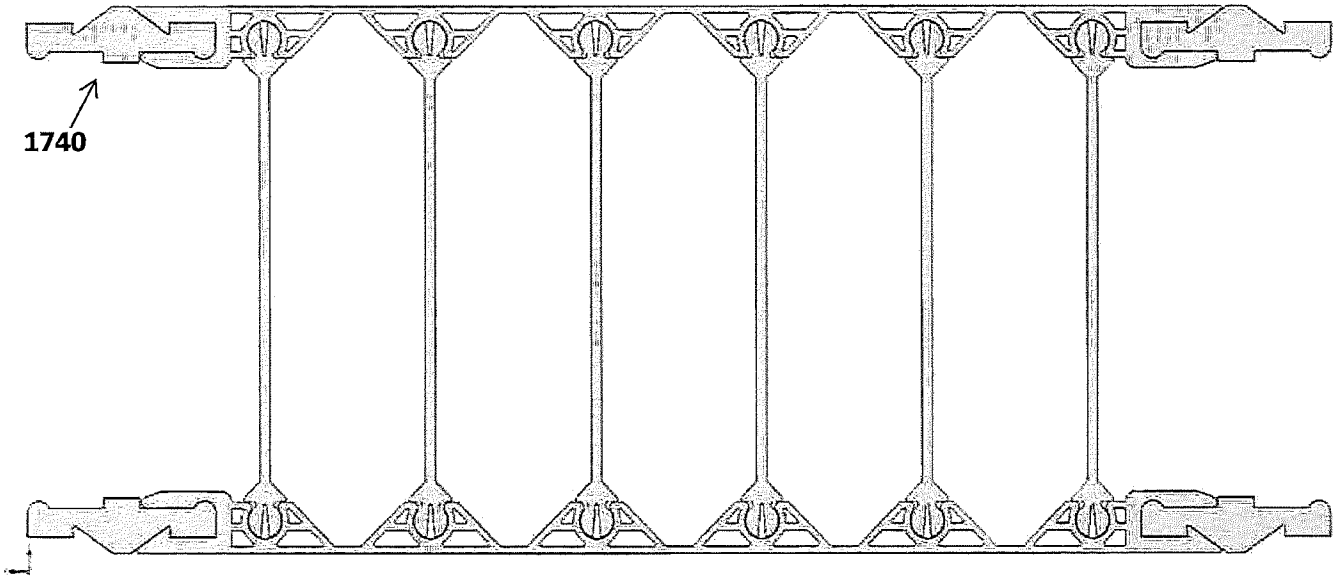
FIG. 17 illustrates a variation of FIG. 11A.

FIG. 17 illustrates a variation of FIG. 11A, in which the key joint members 1740 have a different shape. An elongate longitudinal aperture is shown in the key joint members 1140 of FIG. 12B which is absent from the key joint members 1740 of FIG. 17.

Figure 16A:
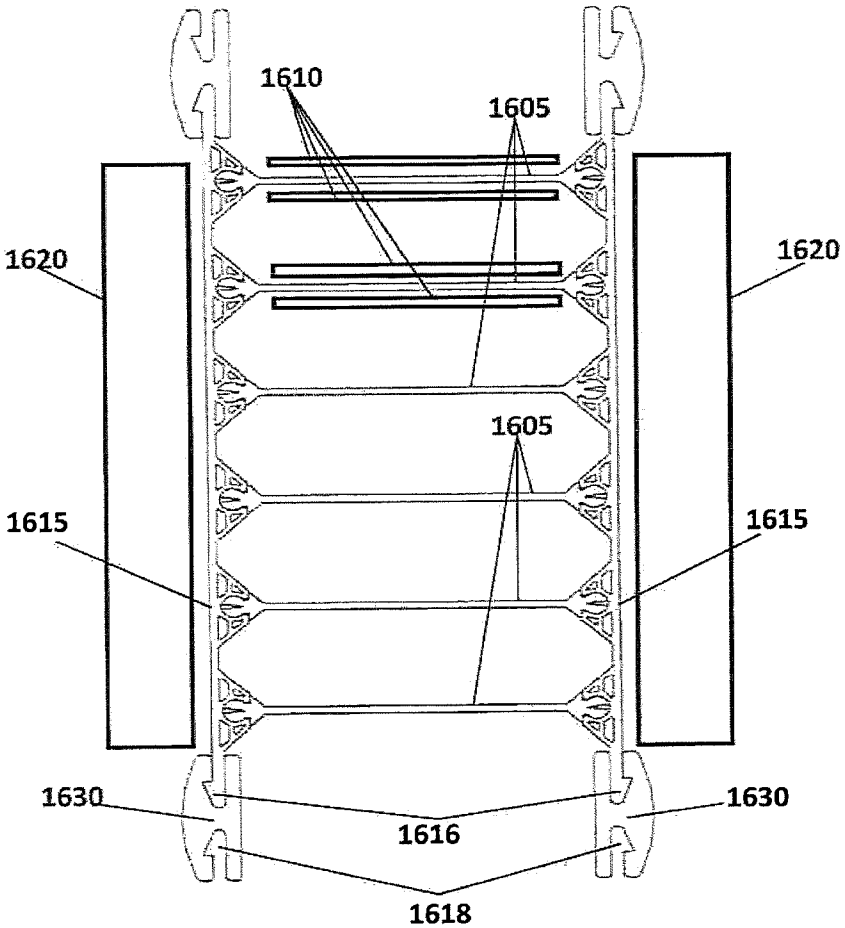
FIGS. 16A to 16C illustrate a method and apparatus for assembling a structure assembly panel using rollers, according to an embodiment of the present invention.

As an alternative, the grooves can be provided in the key joint members rather than in the sidewall components. FIG. 16A illustrates this alternative. That is, the sidewall components 1615 may include a longitudinally oriented end protrusion 1616 extending from an end face thereof, the end protrusion configured to matingly and resiliently engage with an end groove 1618 formed in one of the key joint members 1630 in a snap-in configuration.

Embodiments of the present invention utilize elongated snap-in connectors (also known as snap-fit joints) for interconnection of sidewall components. In general, an elongated snap-in connector includes an elongate groove and an elongate protrusion which is shaped to matingly fit within the groove. In order to achieve the mating fit, at least a portion of the protrusion has a cross section which is shaped similarly to a corresponding portion of the groove. Furthermore, the groove includes a tapered cross section, hook, narrowed opening, or similar feature which serves to retain the protrusion within the groove once fitted therein. The groove, the protrusion, or both, are made of a resilient but deformable material, such as plastic. The protrusion is pressed into the groove by applying a force in the direction leading from the surface opening of the groove to the bottom of the groove. One or both of the groove and the protrusion resiliently and temporarily deform during this pressing process. The cross-sectional shape of the groove retains the protrusion within the groove.

It is noted that the sidewall components and rib components described herein can be provided using a limited amount of material, in order to limit cost and weight thereof. For example, the ribs illustrated in FIGS. 11A and 12D have a narrow central portion and flared end portions. This provides for adequately wide side faces at the ends of the ribs which contact the sidewalls, in order keep the ribs rotationally fixed and contribute to rigidity of the assembled structure. However, at the same time, the ribs narrow inward from the flared end portions in order to reduce the amount of material used therein. As another example, the sidewalls illustrated in FIGS. 11A and 12A include reinforced sections which are sufficiently thick to house the grooves. The reinforced sections include gaps which allow for a reduction in material used. The reinforced sections may be spaced apart, further allowing for a reduction of material. Furthermore, narrowed, non-reinforced sections are located between successive reinforced sections. These narrowed sections may also provide for a desired amount of flexibility.

Figure 13:
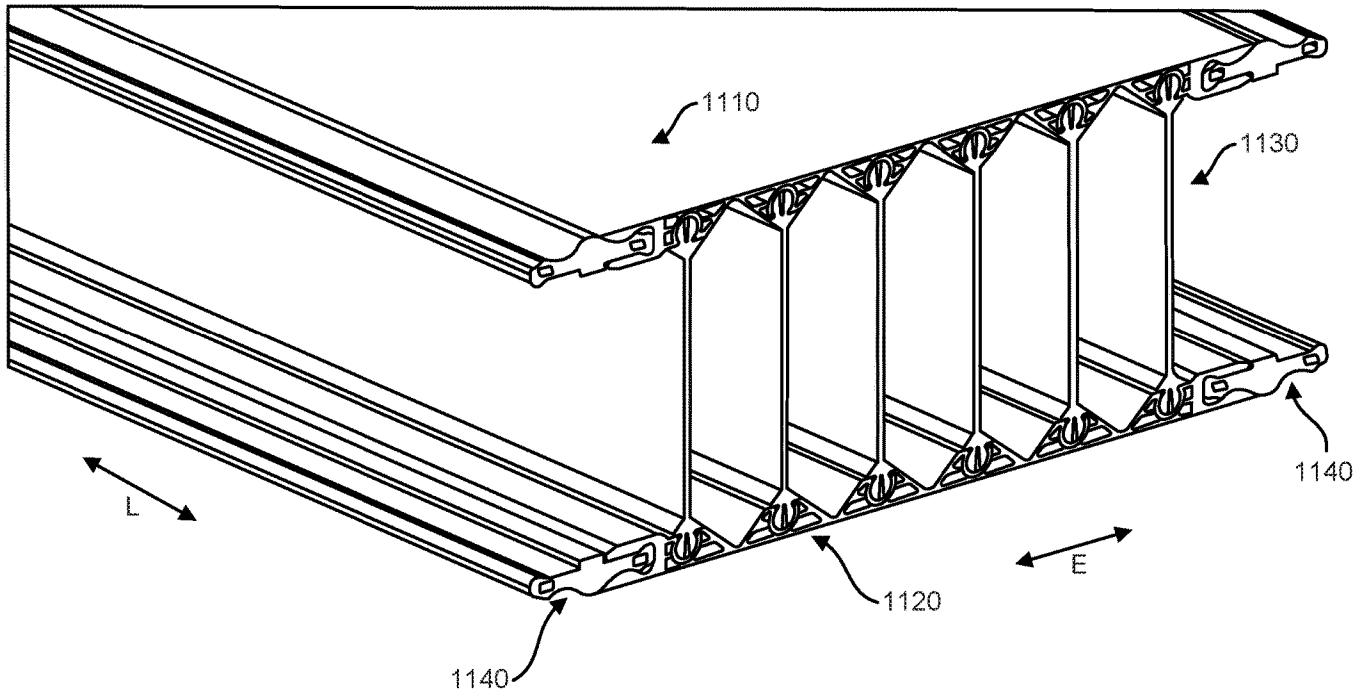
FIG. 13 illustrates a perspective view of the assembled panel of FIG. 11A.
Figure 14A:
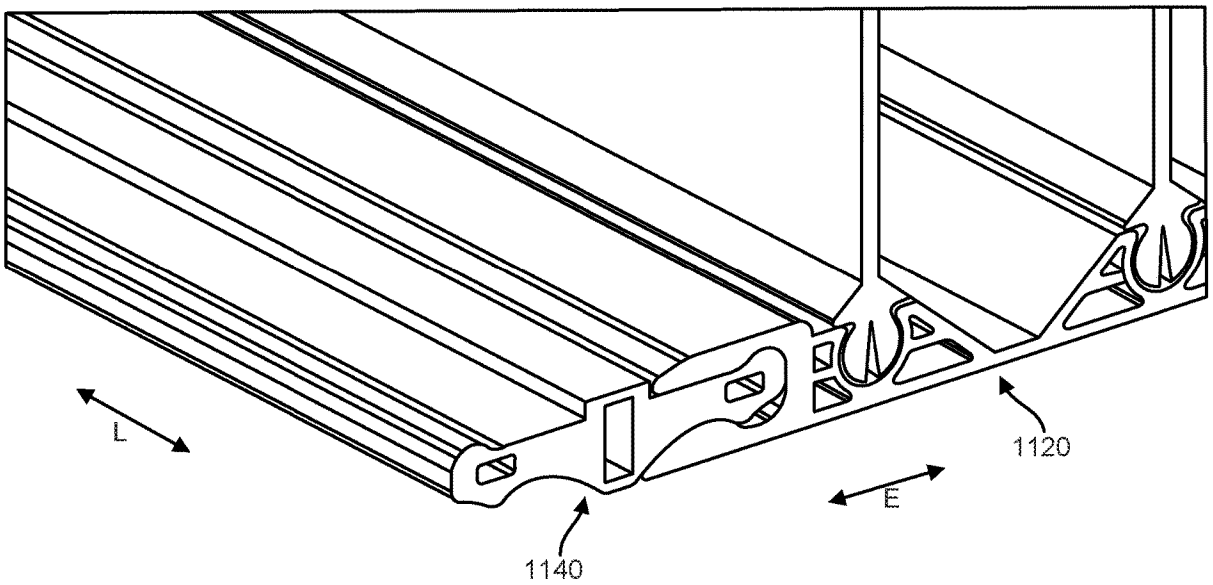
FIG. 14A illustrates a close-up view of a portion of FIG. 13.
Figure 14B:
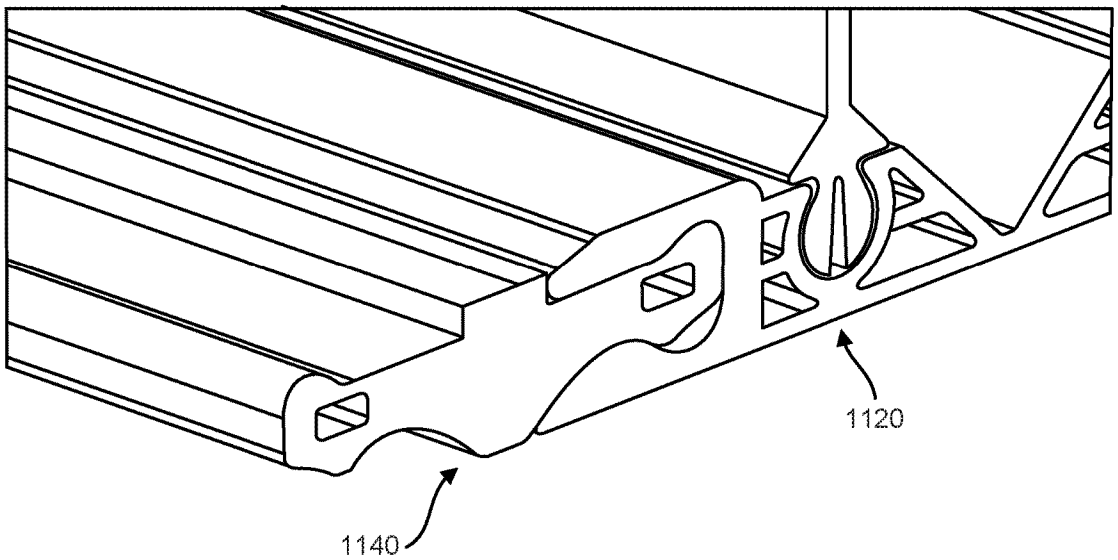
FIG. 14B illustrates another close-up view of a portion of FIG. 13.

FIG. 13 illustrates a perspective view of the assembled panel of FIG. 11A, FIG. 14A illustrates a close-up view of a portion of FIG. 13, and FIG. 14B illustrates another close-up view of a portion of FIG. 13. The various components of the panel extend in the longitudinal direction L to provide a two-dimensional panel structure. FIG. 14B illustrates detail of a key joint member 1140 engaged with an end groove, as described above.

Figure 15:
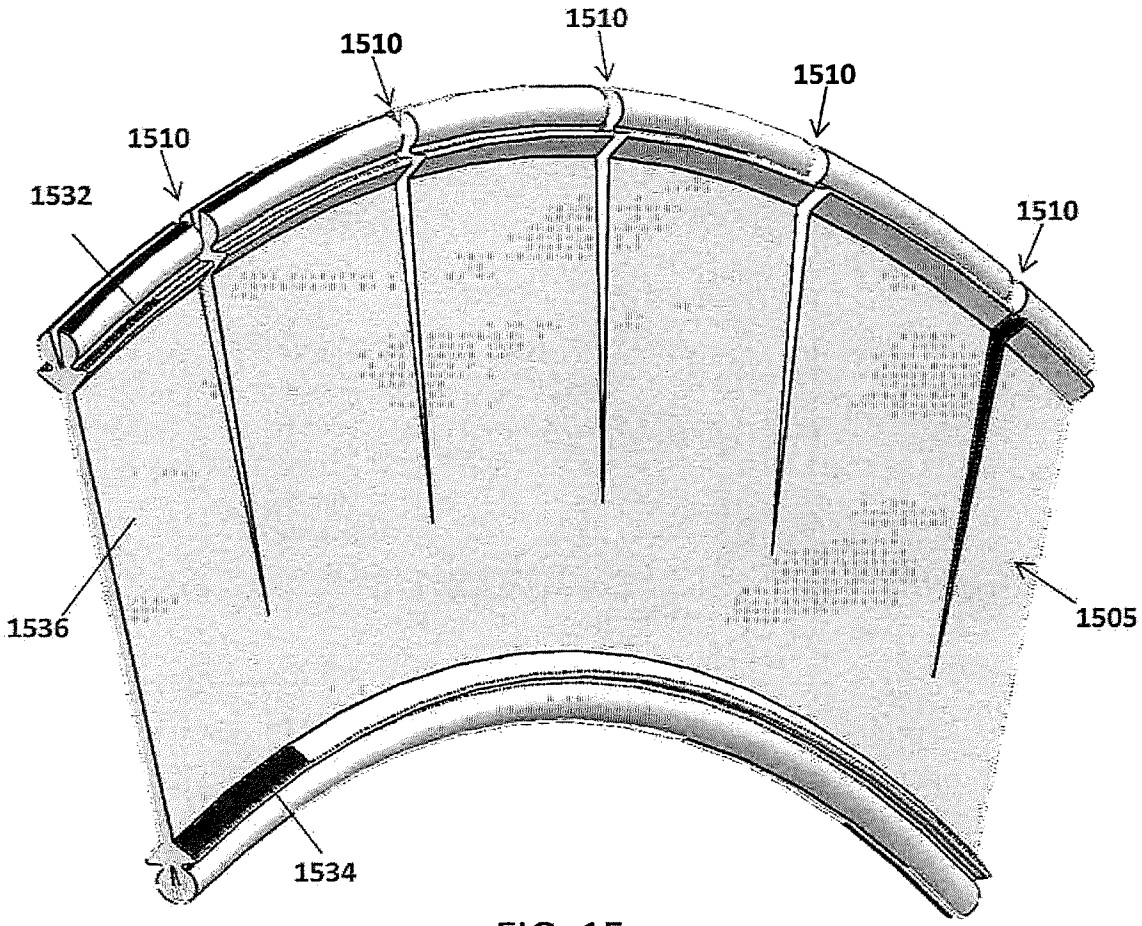
FIG. 15 illustrates a rib having cuts for allowing the rib to be curved, according to an embodiment of the present invention.

In some embodiments, the sidewall components may be curved in the cross section along the longitudinal direction, which may require the protrusion of the rib component to have the same curvature as its engaging sidewall component. Having reference to FIG. 15, the rib 1505 has protrusions 1532 and 1534 along two curved edges of a connecting body 1536. Each protrusion has a same curvature as its engaging sidewall. The two protrusions could have the same curvature so that a parallel curved sidewalls can be connected together to form an assembled panel of uniform thickness. Of course, the two protrusions may have different curvatures to connect two sidewalls with different curvatures to form an assembled panel with non-uniform thickness according to the requirement. In this embodiment, one or more cuts 1510 (e.g. kerf cuts) can be formed in the rib 1505 used to connect such curved sidewalls. The cuts extend from one edge of each rib to an interior portion thereof. The edge in which the cut is formed can be one of the edges holding an elongated protrusion. The cuts allow the protrusions to have more flexibility for curving in order to match their longitudinal curvature to that of the curved sidewall components.

Figure 16B:
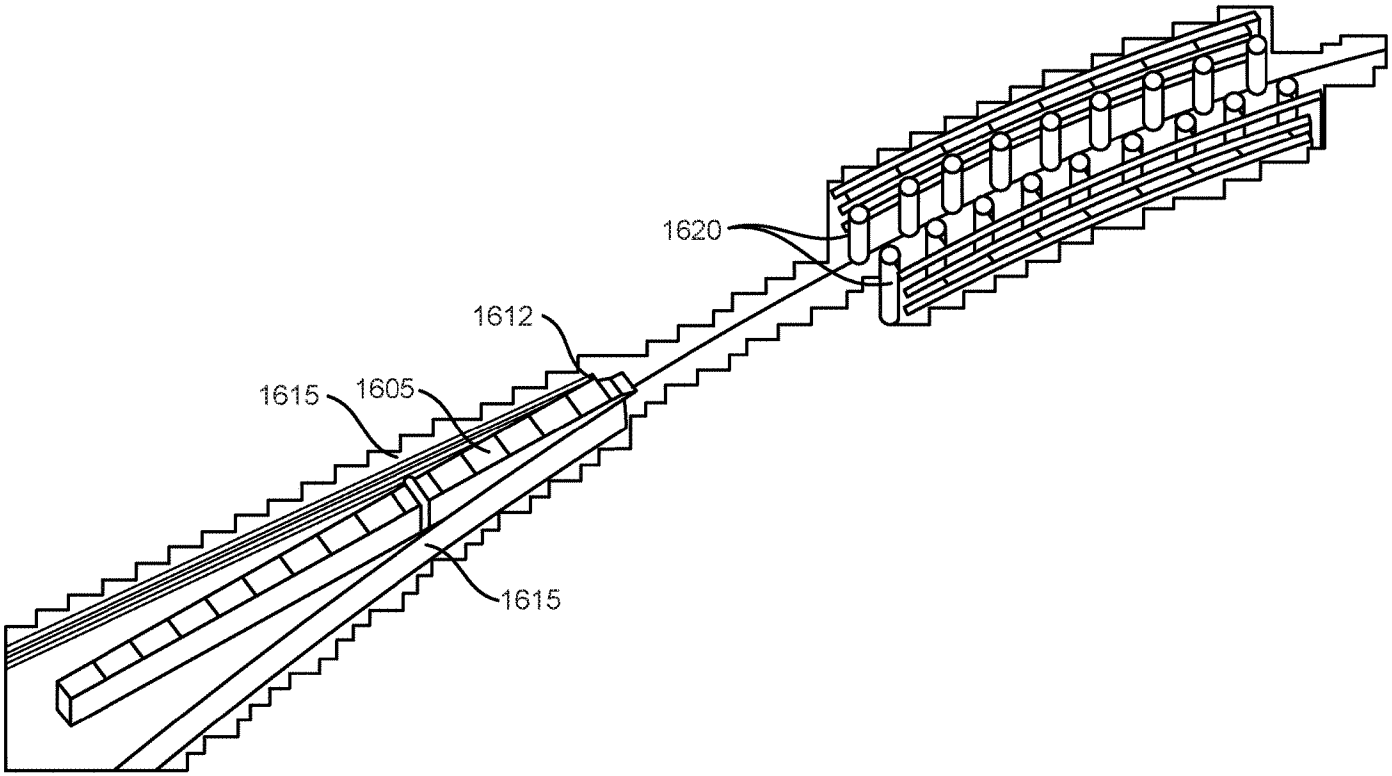
Figure 16C:
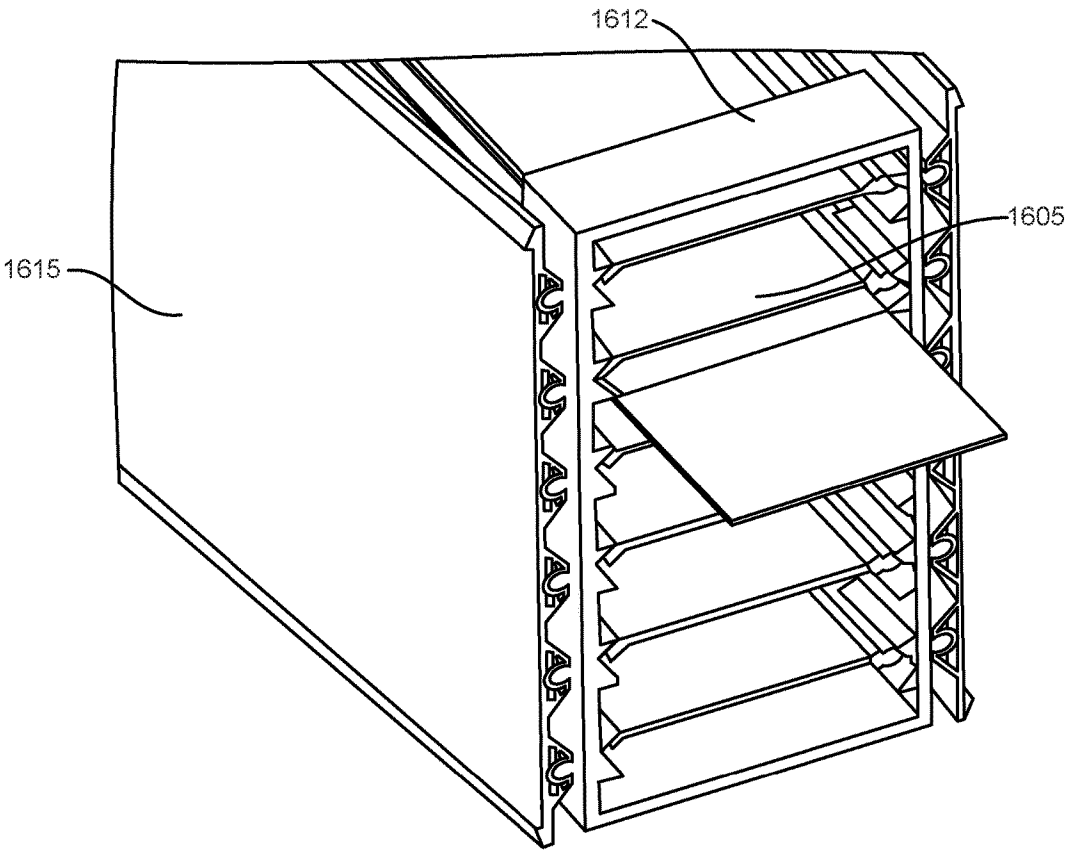

FIGS. 16A to 16C illustrate a method and apparatus for assembling a structure assembly panel, according to an embodiment of the present invention. As shown in FIG. 16A, multiple ribs 1605 are oriented horizontally and supported by rollers 1610. Each of the sidewalls 1615 comprises a set of spaced-apart longitudinally oriented grooves disposed in a first face thereof. The sidewalls 1615 are oriented vertically with their first faces facing the rib components and placed adjacent to the ribs 1605, such that the elongated protrusions of the ribs align with the grooves of the sidewalls. The sidewalls and ribs are passed through pressure rollers 1620 which promote the snap-in fit of the protrusions within the grooves.

FIG. 16B shows the ribs 1605 and sidewalls 1615 prior to passage through the pressure rollers 1620. FIG. 16C shows the ribs, sidewalls, and roller structure 1612 supporting the ribs. Connections between one or more joints of one or more components can be provided with fasteners to facilitate stability. In some embodiments, the fastener is an adhesive which is applied to joint connections. In some embodiments the joints are connected via fasteners such as screws, bolts, etc.

It should be understood that any of the foregoing configurations and specialized components or may be interchangeably used with any of the apparatus or systems of the preceding embodiments. Although illustrative embodiments are described hereinabove, it will be evident to one skilled in the art that various changes and modifications may be made therein without departing from the scope of the disclosure. It is intended in the appended claims to cover all such changes and modifications that fall within the true spirit and scope of the disclosure.

In some embodiments, the present invention relates to a structural assembly/building structure comprising the panels as described above which are connected via the central joint support members and the resilient key finger joint members as described above.

Figure 18:
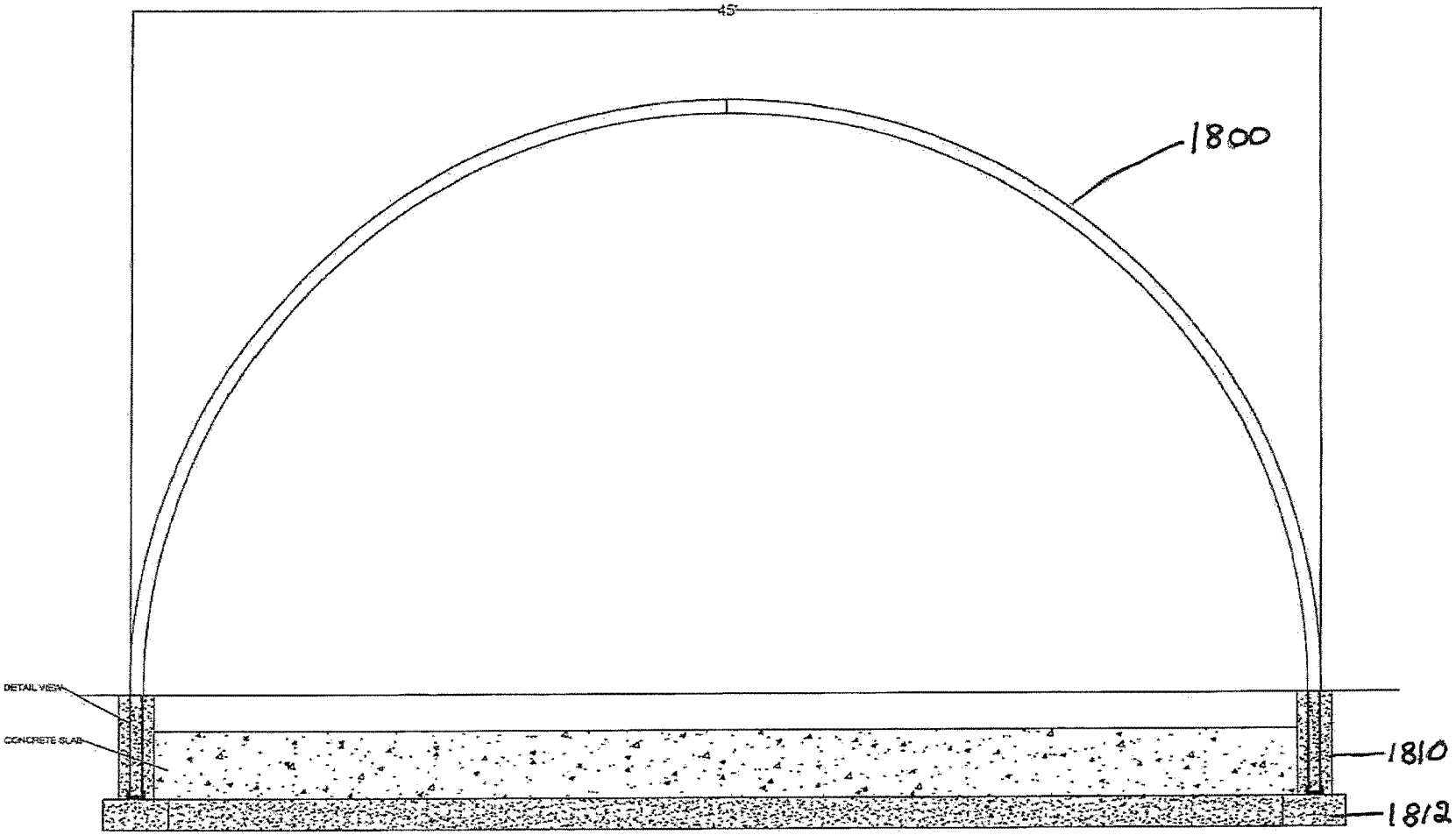
FIG. 18 illustrates an end view of a structural assembly/building structure comprising the panels in accordance with an embodiment of the present invention.

FIG. 18 illustrates an end view of a structural assembly/building structure 1800 comprising the panels in accordance with an embodiment of the present invention; and FIG. 19 illustrates an enlarged view of an end of FIG. 18. As seen in FIGS. 18 and 19, a foundation panel or base support 1810 can be provided adjacent to a concrete footing 1812 and surrounded by concrete inner and outer walls 1814 and 1816 or gravel fill. The foundation panel can be anchored in place using a U-shaped member 1818 affixed to the concrete footing, The U-shaped member has sidewalls which extend around a bottom of the foundation panel. The U-shaped member can be an elongated trough-type piece which is connected to the concrete foundation using screws, for example. The foundation panel 1810 has a bottom end below grade and a top end above or at grade. In some embodiments, the top end is connected to a curved upper wall panel.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A modular system for constructing a structure assembly, the system comprising:

first and second sidewall components, each sidewall component comprising a set of longitudinally oriented reinforced sections, each reinforced section comprising a pair of mutually facing hook members, each member of each pair being anchored to a different respective portion of a first face of the side wall component, thereby defining spaced-apart longitudinally oriented grooves disposed in the first face, wherein the grooves include a first portion in which a width of the grooves increases with depth into the grooves; and a plurality of rib components, each rib component having a pair of flared ends and a pair of elongated protrusions, extending from opposing sides of the rib component wherein each protrusion being shaped to matingly engage with at least the first portion of one of the grooves to connect the first and second sidewall components along a face-to-face direction, wherein the protrusions are configured to be pressed into the grooves in a direction which is locally perpendicular to the respective sidewall component having the grooves, and wherein one or both of the protrusions of each pair of elongated protrusions and the grooves are configured to be temporarily deformed when each protrusion is pressed into the grooves;

wherein at least one of the flared ends includes a side face which engages with an outer surface of the hook members of one of the reinforced sections when one of the protrusions of at least one rib component of said plurality of rib components is matingly engaged with one of the grooves of said one of the sidewall components.

2. The system of claim 1, wherein the first and second sidewall components are disposed in a spaced-apart configuration with said first faces thereof facing one another, and each of the plurality of rib components is connected to both the first and second sidewall components by disposing the protrusions within the grooves.

3. The system of claim 1, wherein the protrusions are substantially circular in cross section and include a notch formed in ends thereof.

4. The system of claim 1, wherein the sidewall components are curved in the longitudinal direction, and the protrusions of each of the rib components are curved and having the same curvature as the sidewall components, and each of the ribs components comprises one or more cuts extending to one edge thereof, thereby allowing for curvature of the ribs in conformance with the sidewall components.

5. The system of claim 1, further comprising two elongate key joint members, wherein each of the sidewall components further comprises a longitudinally oriented end groove disposed within an end face thereof, the end groove configured to matingly and resiliently engage with one of the key joint members in a snap-in configuration, wherein the two key joint members are further configured to matingly and resiliently engage with two respective additional sidewall components using another snap-in connection, thereby connecting the sidewall components with the additional sidewall components along a transverse direction perpendicular to the face-to-face direction in a side to side relationship.

6. The system of claim 1, further comprising two elongate key joint members, wherein each of the sidewall components further comprises a longitudinally oriented end protrusion extending from an end face thereof, the end protrusion configured to matingly and resiliently engage with an end groove formed in one of the key joint members in a snap-in configuration, wherein the two key joint members are further configured to matingly and resiliently engage with two respective additional sidewall components using another snap-in connection, thereby connecting the sidewall components with the additional sidewall components along a transverse direction perpendicular to the face-to-face direction in a side to side relationship.

7. A structure assembly panel constructed from the system of claim 1.

8. The structure assembly panel of claim 7, wherein the first and second sidewall components are disposed in a spaced-apart configuration with said first faces thereof facing one another, and each of the plurality of rib components is connected to both the first and second sidewall components by disposing the protrusions within the grooves.

9. The structure assembly panel of claim 8, wherein the protrusions are substantially circular in cross section and include a notch formed in ends thereof.

10. The structure assembly panel of claim 8, wherein the sidewall components are curved in the longitudinal direction, and the protrusions of each of the rib components are curved and having the same curvature as the sidewall components, and each of the ribs components comprises one or more cuts extending to one edge thereof, thereby allowing for curvature of the ribs in conformance with the sidewall components.

* * * * *